US010094081B1

(12) United States Patent
Gill et al.

(10) Patent No.: US 10,094,081 B1
(45) Date of Patent: Oct. 9, 2018

(54) PARKING SPACE HOLDER

(71) Applicant: James G. Gill, North Hollywood, CA (US)

(72) Inventors: James G. Gill, N. Hollywood, CA (US); Jurgen S. Heimann, Sherman Oaks, CA (US)

(73) Assignee: James G. Gill, North Hollywood, CA (US)

( * ) Notice: Subject to any disclaimer, the term of this patent is extended or adjusted under 35 U.S.C. 154(b) by 0 days.

(21) Appl. No.: 15/346,791

(22) Filed: Nov. 9, 2016

Related U.S. Application Data

(60) Provisional application No. 62/252,820, filed on Nov. 9, 2015.

(51) Int. Cl.
*E01F 13/00* (2006.01)
*E01F 13/04* (2006.01)

(52) U.S. Cl.
CPC ..... *E01F 13/042* (2013.01)

(58) Field of Classification Search
CPC ..... E01F 13/047
USPC ..... 49/49; 160/328, 327, 330
See application file for complete search history.

(56) References Cited

U.S. PATENT DOCUMENTS 484,572 A * 10/1892 Rudert ..... E05F 13/04 49/132
1,277,201 A * 8/1918 Doser ..... B61L 29/226 246/128
1,642,875 A * 9/1927 Fitch ..... E05F 11/00 160/328
1,832,812 A * 11/1931 Keenan ..... B61L 29/224 246/127
2,663,103 A * 12/1953 Ellison ..... G07F 17/145 49/264
4,281,524 A * 8/1981 Linder ..... E01F 13/04 49/34
4,325,146 A 4/1982 Lennington
4,333,268 A * 6/1982 Dumbeck ..... E01F 13/04 429/8
4,553,739 A * 11/1985 Baines ..... E06B 11/021 24/69 T
4,665,395 A 5/1987 Van Ness
RE32,934 E * 5/1989 Baines ..... E06B 11/021 24/69 T
4,894,654 A 1/1990 Serenbetz
(Continued)

FOREIGN PATENT DOCUMENTS

EP 1380694 A2 * 1/2004 ..... E01F 13/028

*Primary Examiner* — Jerry E Redman
(74) *Attorney, Agent, or Firm* — James Creighton Wrey; Meera P. Narasimhan

(57) ABSTRACT

A parking space is reserved by raising a chain about three feet above a parking space. The chain is attached to a post, and a weight is attached to the chain to lower the chain along the post and to drag the lowering chain along the parking space toward the post for full access. A motor with a speed reducer turns a shaft with a chain drive gear and an encoder. A signal receiver and control start the motor to raise or lower the chain when one of two buttons is pressed on a key fob by the authorized space user. The encoder is connected to the control to stop the chain when fully up or down. A stop trigger on the chain activates a stop switch when the chain is fully raised.

19 Claims, 11 Drawing Sheets

(56) References Cited

U.S. PATENT DOCUMENTS

| | | | | | |
|---|---|---|---|---|---|
| 5,245,787 | A * | 9/1993 | Swenson | E01F 13/028 | 404/9 |
| 5,452,542 | A * | 9/1995 | Bardwell | E01F 13/028 | 49/322 |
| 5,537,778 | A * | 7/1996 | Bardwell | E01F 13/028 | 49/322 |
| 5,871,038 | A * | 2/1999 | Gompertz | E01F 13/028 | 160/328 |
| 6,035,921 | A * | 3/2000 | Minow | A01K 1/0017 | 160/328 |
| 6,150,958 | A | 11/2000 | Worsham | | |
| 6,192,627 | B1 * | 2/2001 | Gompertz | E01F 13/028 | 160/330 |
| 6,344,806 | B1 | 2/2002 | Katz | | |
| 6,349,503 | B1 * | 2/2002 | Gompertz | E01F 13/028 | 49/34 |
| 6,485,225 | B1 * | 11/2002 | Baker | E01F 13/028 | 160/331 |
| 6,845,589 | B1 * | 1/2005 | Thompson | E05B 65/0007 | 49/34 |
| 7,195,419 | B2 * | 3/2007 | Gelfand | E01F 13/12 | 404/6 |
| 7,312,722 | B2 | 12/2007 | Tillotson | | |
| 8,618,906 | B2 | 12/2013 | Al-Jafar | | |
| 8,742,949 | B2 | 6/2014 | Chang | | |
| 8,794,866 | B2 | 8/2014 | Petryshyn | | |
| 2003/0029090 | A1 * | 2/2003 | Gillingham | E01F 13/048 | 49/49 |
| 2007/0085067 | A1 | 4/2007 | Lewis | | |
| 2012/0284209 | A1 | 11/2012 | Duffy | | |

* cited by examiner

PLASTIC CHAIN GUIDE

STOP SWITCH TRIGGER

DRIVE SHAFT

CHAIN ROLLER

FRAME PLATES

BATTERY SHELF

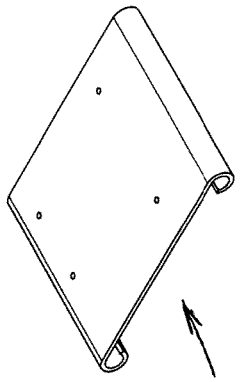
Fig. 11a
112
Fig. 11c
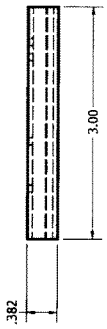
CIRCUIT BOARD SHELF
Fig. 11b
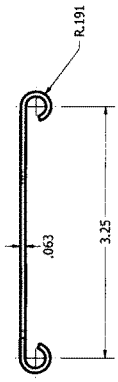
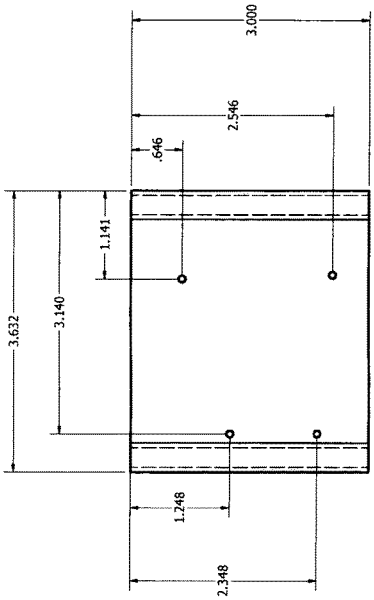
Fig. 11d

PARKING SPACE HOLDER

This application claims the benefit of U.S. Provisional Application No. 62/252,820 filed Nov. 9, 2015, which is hereby incorporated by reference in its entirety as if fully set forth herein.

SUMMARY OF THE INVENTION

A parking space holder has a chain fixed at one end. At the opposite end the chain is lifted and lowered. A driver approaching a reserved parking space pushes a button or a code, and the chain is lowered. After leaving the parking space, the driver pushes a button (or a code), and a motor raises a chain to hold the parking space reserved.

The structure is stationary. A battery driven motor with a reduction gear is mounted on the plate at the right. A drive shaft is connected to the reduction gear with a flexible coupling. The drive shaft extends through bearings in plates and rotates a chain lifting and lowering gear.

The chain raising and lowering device is small, self-contained and battery operated and may be mounted where a free end of a parking space holder chain is normally hooked. The new lowering and lifting device saves an owner from getting out and in a car when parking or after leaving a parking space.

The invention provides a new parking space holder that prevents unauthorized users from entering a parking space when the authorized user is absent. One end of a chain is fixed to a post at one side of a parking space entry. The other end of the chain is attached to battery-powered motor-driven chain drive at the other side of the entry.

When a driver wishes to enter her parking space, she presses a button on a remote handheld device, and a chain gear driven by the small motor lowers the chain. A weight on the chain near the fixed end or a spring loaded arm pulls that side of the chain down to an inch or more from the ground, drawing part of the lowered chain across toward the fixed end and ensuring lowering of the entire chain.

An encoder or a current sensor connected to the chain gear drive stops the motor after sufficient turns to lower or raise the chain.

After the driver leaves the space, a press of a button activates the motor to drive the chain gear to raise the chain for preventing other vehicles from entering the space. A small solar panel maintains the charge of the battery powering the raising and lowering motor. A stop on the chain deactivates the motor when the chain is fully raised.

These and further and other objects and features of the invention are apparent in the disclosure, which includes the above and ongoing written specification, with the claims and the drawings.

A parking space reserver has a flexible barrier for raising to reserve a parking space and lowering to permit access to the parking space. A holder positioned above one side of the parking space is connected to one end of the flexible barrier. A weight is connected to the flexible barrier near the holder for lowering a part of the flexible barrier near the holder. A drive unit mounted above one other side of the parking space is connected to a portion of the flexible barrier remote from the holder for selectively pulling in and raising the flexible barrier to a parking space reserving position and paying out and lowering the flexible barrier to a parking space accessing position.

A control is connected to the drive unit for controlling, starting and stopping the drive unit and pulling in or paying out of the flexible barrier for respectively raising or lowering the flexible barrier.

In one embodiment the end holder is connected to a post about three feet above the one side of the parking space, and the drive unit is fixed on a support spaced and opposite from the post and about three feet above the other side of the parking space. In one embodiment the flexible barrier is a chain and the drive unit is mounted on a wall spaced from the post.

In one embodiment the drive unit has an electric motor. A power source is connected to the motor. A speed reducer connected to the motor and a shaft is connected to the speed reducer.

A flexible barrier drive gear is connected to the shaft and to the flexible barrier for raising and lowering the flexible barrier.

A frame supports the shaft, and a housing is connected to the frame for supporting the electric motor and the speed reducer.

A stop switch is connected to the frame, and a stop switch trigger is connected to the flexible barrier for engaging the stop switch to stop retracting and raising of the flexible barrier at a desired parking space blocking height. A flexible barrier guide is attached to the frame for aligning the flexible barrier with the drive gear. In one embodiment the flexible barrier is a chain, and the flexible barrier guide is a chain guide for aligning links of the chain with the drive gear. An encoder is connected to the shaft for providing the number of revolutions of the shaft and thereby providing information on a position of the flexible barrier.

In one embodiment of the invention, the power supply is a battery, and a battery holder is connected to the frame. A solar panel is mounted nearby, and electrical connectors connect to the solar panel to the battery holder. Front and back covers are connected to the frame and to each other for housing the motor, the speed reducer, the shaft, the drive gear, the encoder and the battery holder.

A signal receiver and a controller are mounted on the frame. The controller is connected to the signal receiver and to the motor for controlling the motor. A remote control signals the receiver for controlling the raising or lowering of the flexible barrier.

A parking space is reserved by raising a chain about three feet above a parking space. The chain is attached to a post, and a weight is attached to the chain to lower the chain along the post and to drag the lowering chain along the parking space toward the post for full access. A motor with a speed reducer turns a shaft with a chain drive gear and an encoder. A signal receiver and control start the motor to raise or lower the chain when one of two buttons is pressed on a key fob by the authorized space user. The encoder is connected to the control to stop the chain when fully up or down. A stop trigger on the chain activates a stop switch when the chain is fully raised.

BRIEF DESCRIPTION OF THE DRAWINGS

FIGS. 11*a-d* show details of a circuit board shelf.

DETAILED DESCRIPTION

Figure 1:
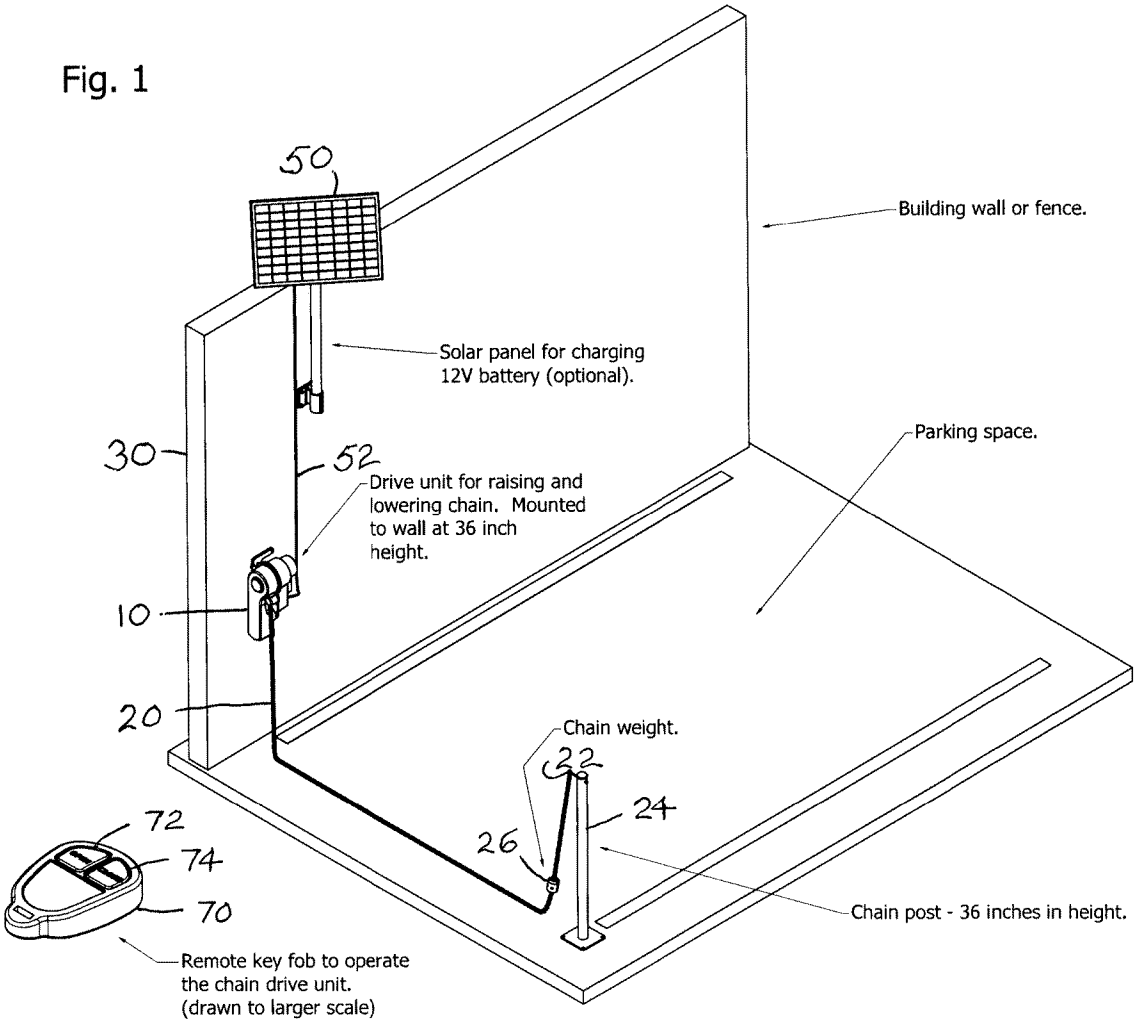
FIG. 1 is a schematic representation of the new parking space holder.

FIG. 1 is a schematic representation of the new parking space holder. A chain drive unit 10 for raising and lowering a chain 20 is mounted about 36 inches high on a wall 30 or a post at one side of a parking space 40 delineated by lines 42.

Chain 20 has one end 22 fixed at or near a top of a post 24, which is about 36 inches high. A weight 26 on the chain 20 pulls the chain downward along post 24 as the chain is lowered.

A 12 volt battery mounted on chain drive unit 10 is connected 52 to a solar panel 50 to store energy and to power a small motor, with a speed reducer that raises and lowers chain 20.

When used in a parking garage, a longer charging connection 52 may be used, or a motor may operate with line current.

A remote key fob 70 has lower and raise (open and close) buttons 72, 74 to start the motor for turning in the desired direction.

Figure 2:
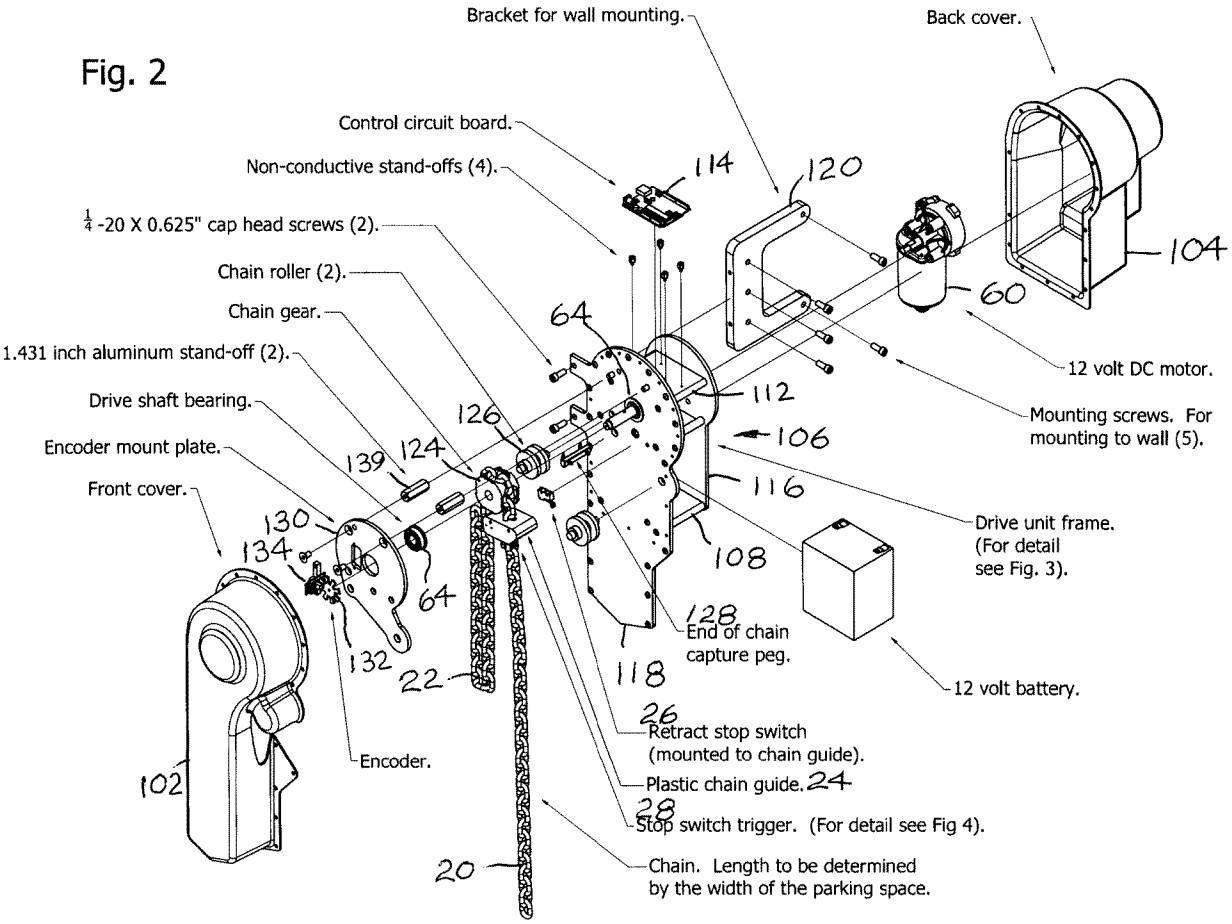
FIG. 2 is a schematic exploded view of a chain lifting and lowering drive and power supply for the parking space holder shown in FIG. 1.

FIG. 2 is a schematic exploded view of a chain lifting and lowering drive and battery for the parking space holder shown in FIG. 1.

Figure 3:
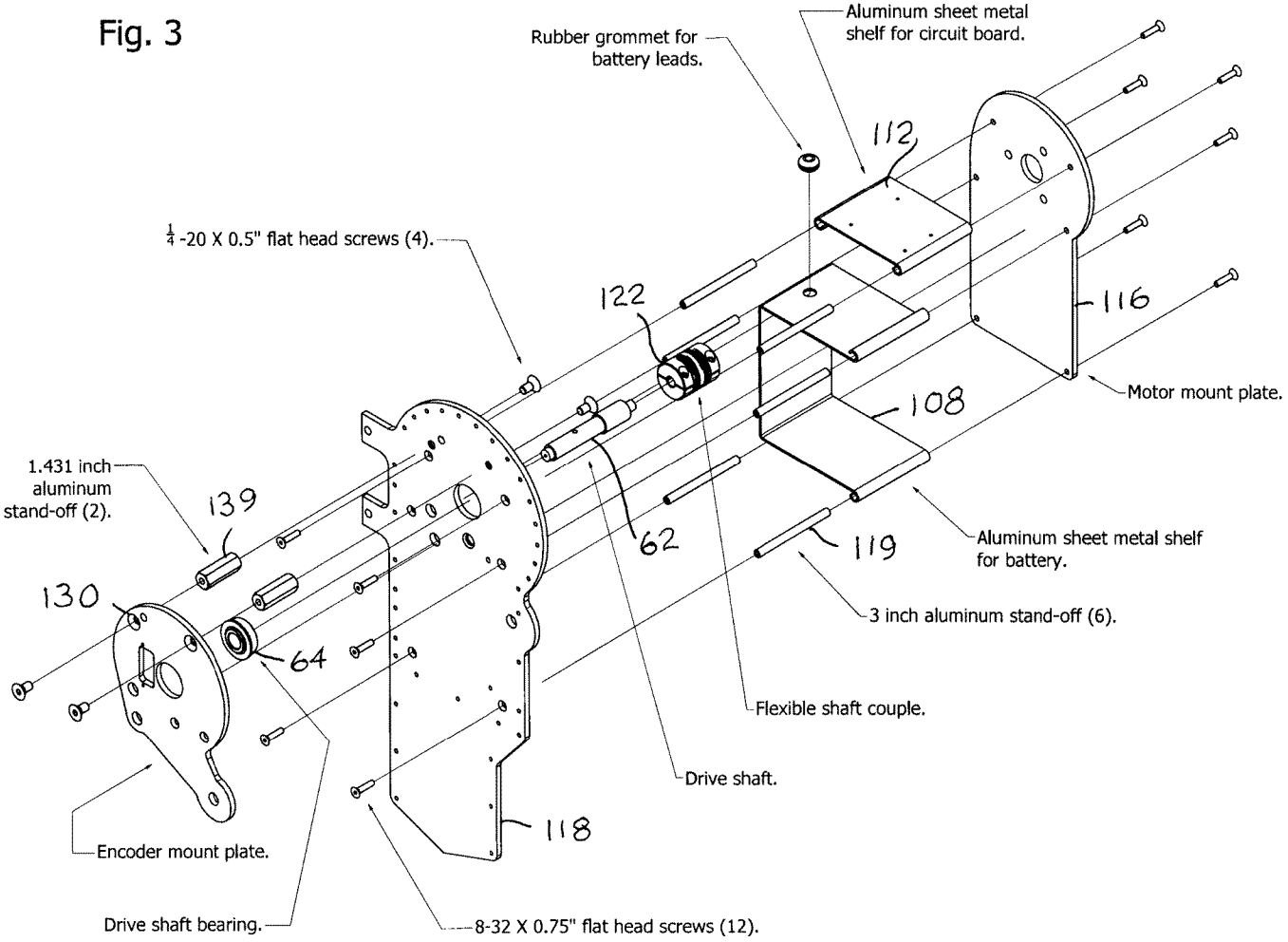
FIG. 3 is a schematic exploded view of mounting frame plates for the chain lifting and lowering drive and battery holder for the parking space holder shown in FIGS. 1 and 2.

FIG. 3 is a schematic exploded view of mounting support plates for the chain lifting and lowering drive and battery shelf for the parking space holder shown in FIGS. 1 and 2.

The parts of the chain control unit 10 include a front cover 102, a back cover 104 and a drive unit frame 106. A battery support shelf 108 holds a 12 volt battery 110. The drive unit frame 106 has a circuit board shelf 112 for mounting a control circuit board 114. Frame 106 has a motor mount plate 116 connected to a larger support plate 118 with stand-offs 119. The stand-offs 119 hold the battery support shelf 108 and the circuit board shelf 112.

A mounting bracket 120 is connected to the frame 106.

A 12 volt drive motor 60 with a reduction gear is mounted on the motor mount plate 116 and is positioned inside the back cover 104.

A drive shaft 62 extends between bearings 64 mounted in the main support plate 118 and the encoder mounting plate 130. Drive shaft 62 is connected to flexible shaft coupler 122 and chain drive gear 124 shown in FIG. 2. Chain guide rollers 126 guide chain 20 onto and off the chain gear 124.

A plastic chain guide 24 is mounted on plate 118 below the chain drive gear 124 to align links in chain 20 to match grooves in the chain drive gear 124.

An end of chain capture peg 128 is mounted on main support plate 118 to hold the near end 21 of the chain 20, resulting in a doubling 22 of the chain 20 as it is taken in by chain gear 124 to raise the barrier.

A retract stop switch 26 is mounted on the chain guide 24. A stop switch trigger 28 is attached to chain 20 in a position that is equivalent to a chain fully or nearly fully raised in the parking space reserving position.

An encoder wheel 132 is connected to an end of the drive shaft. An encoder sensor 134 is mounted on the encoder mounting plate 130. Sensor 134 is connected to the control circuit board 114 to stop the chain drive motor 60 when the chain is in its fully lowered or fully raised position. An adjustment is connected to the control circuit board or the sensor for adjusting the system to the width of the parking space.

Stand-offs 139 are mounted between the main mounting plate 118 and the encoder mounting plate 130. The covers 102 and 104 are connected to the main mounting support plate 118.

Figure 4:
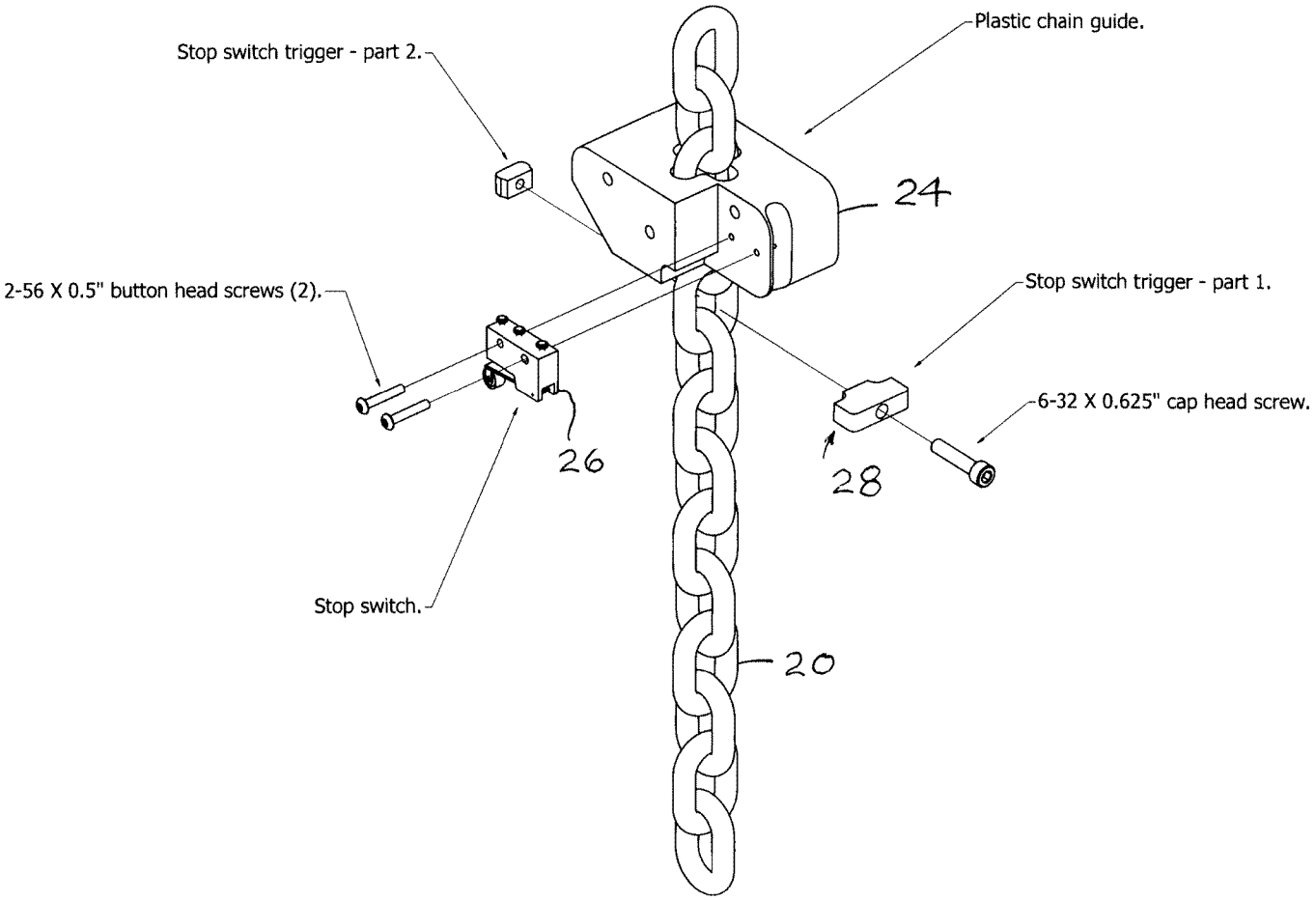
FIG. 4 is an exploded detail of a chain guide and a stop switch for the parking space holder shown in FIGS. 1-3.

FIG. 4 shows details of the retract stop switch 26 connection to the chain guide 24 and the stop switch trigger 28 connected to the chain 20.

Figure 5A:
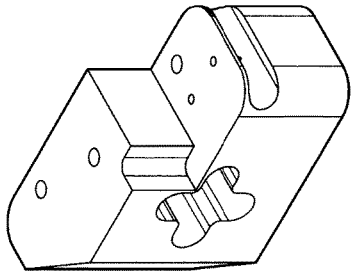
FIGS. 5*a-d* show details of the chain guide shown in FIG. 4.
Figure 5B:
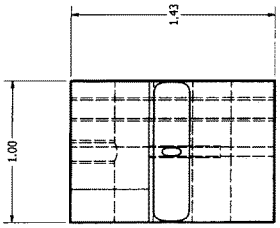
Figure 5C:
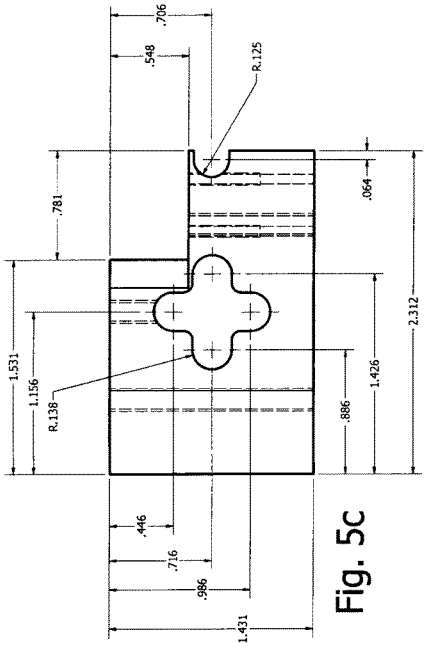
Figure 5D:
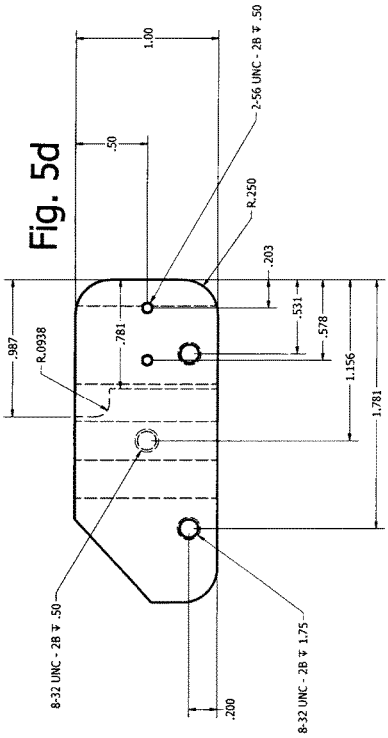

FIGS. 5*a, b, c* and *d* show perspective, front, bottom and side views of the chain guide 24, which aligns chain links with the chain gear.

Figure 6A:
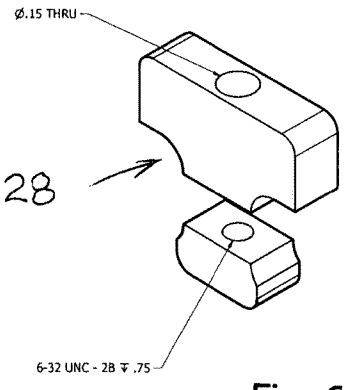
FIGS. 6*a-d* show details of a stop switch trigger shown in FIG. 4.
Figure 6B:
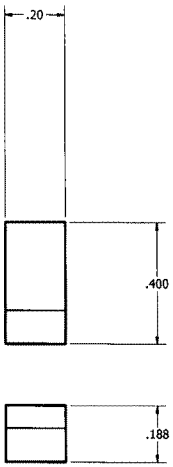
Figure 6C:
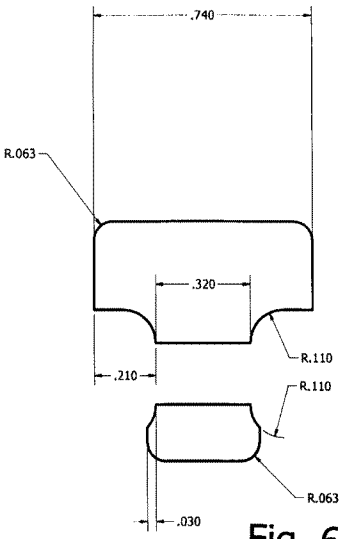
Figure 6D:
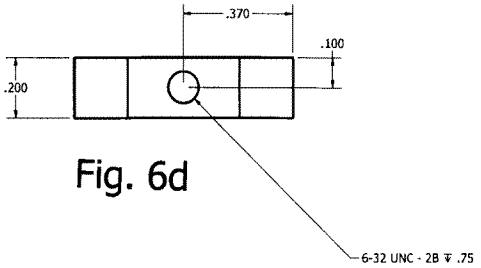

FIGS. 6*a, b, c* and *d* show perspective, side, top and end views of the stop switch trigger 28 which is connected to the chain 20 to move the stop switch 26 and stop the motor when the chain is fully or nearly fully in the up, parking space blocking and reserving position.

Figure 7A:
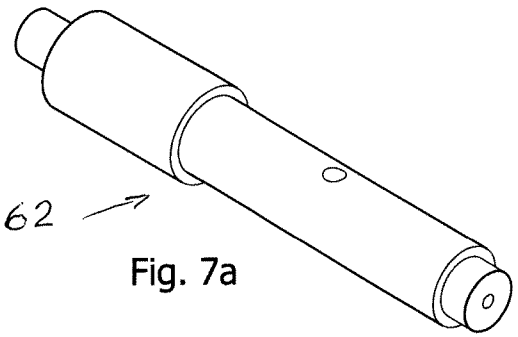
FIGS. 7*a-d* show details of the drive shaft shown in FIG. 3.
Figure 7B:
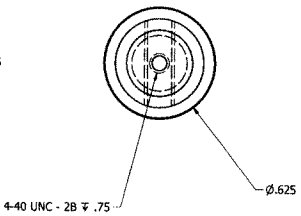
Figure 7D:
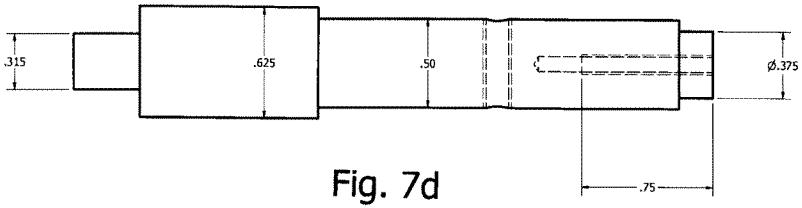
Figure 7C:
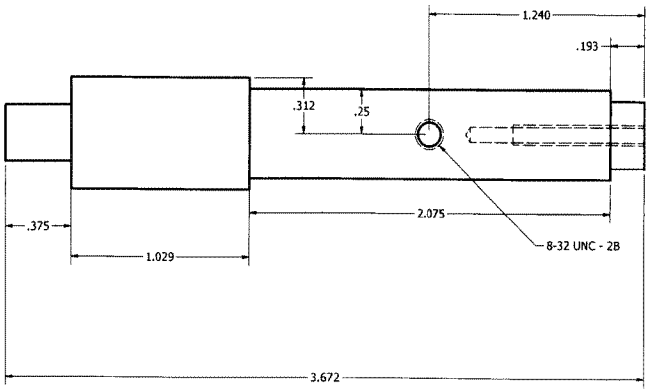

FIGS. 7*a, b, c* and *d* show perspective, end, top and side views of the drive shaft 62.

Figure 8A:
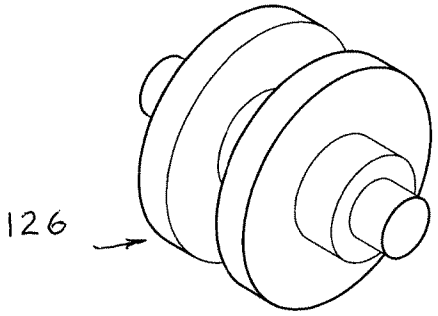
FIGS. 8*a-c* show details of chain rollers shown in FIG. 2.
Figure 8B:
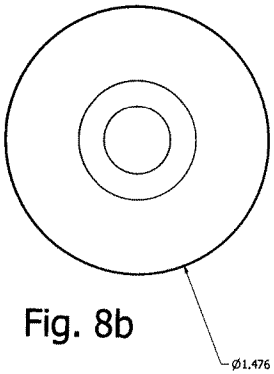
Figure 8C:
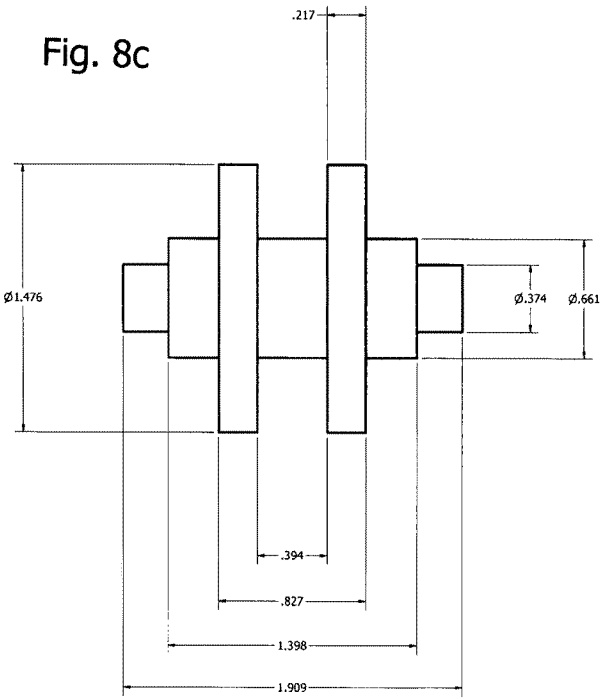

FIGS. 8*a, b* and *c* show perspective, side and end views of one of the two chain rollers 126.

Figure 9:
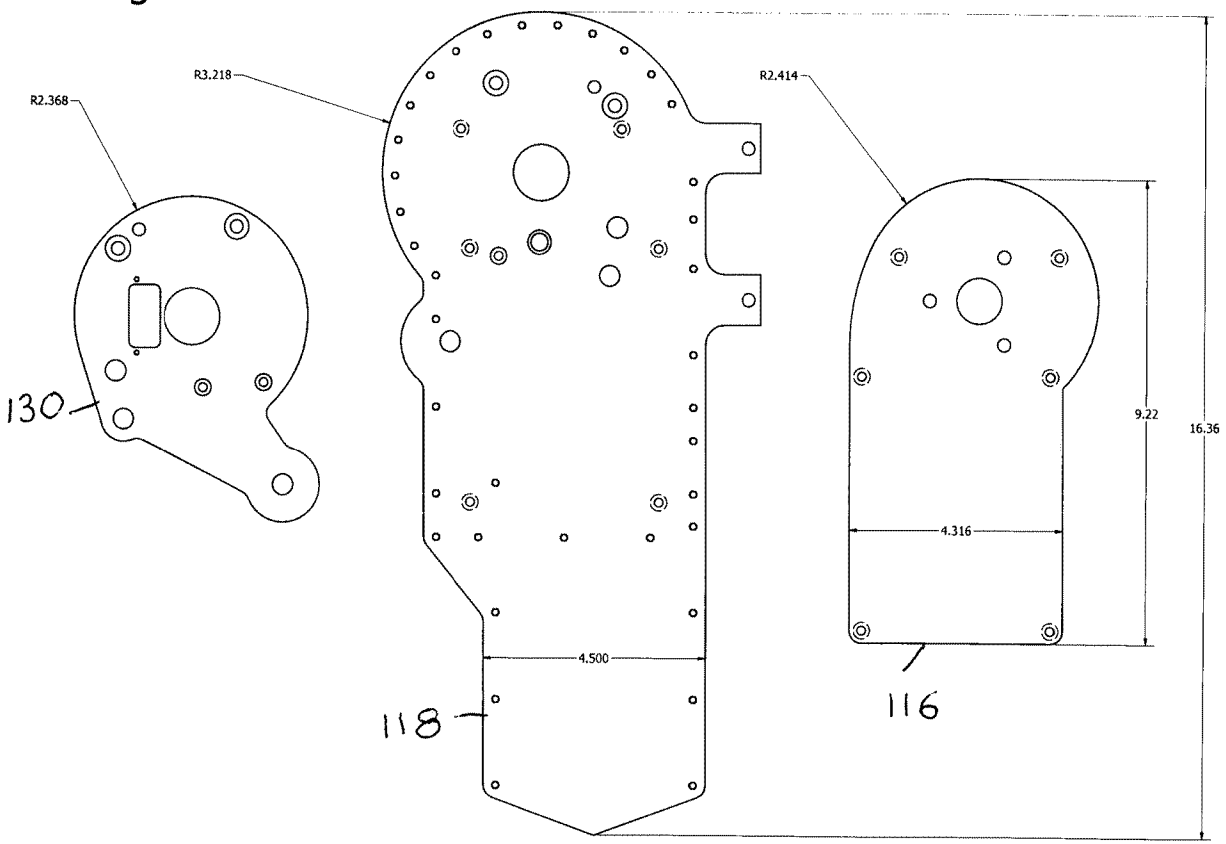
FIG. 9 shows details of frame plates shown in FIGS. 2 and 3

FIG. 9 shows details in elevations of main support plate 118, motor mount plate 116 and encoder mount plate 130.

Figure 10A:
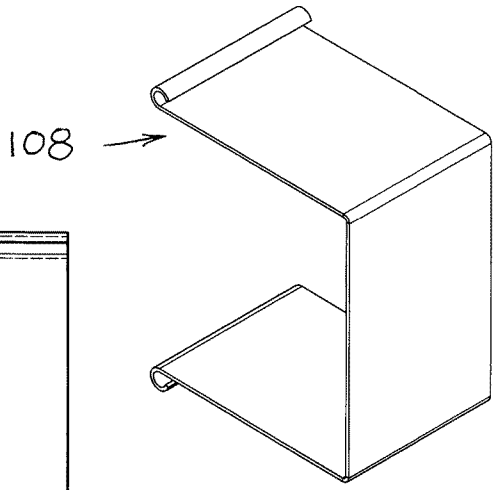
FIGS. 10*a-d* show details of the battery shelf.
Figure 10C:
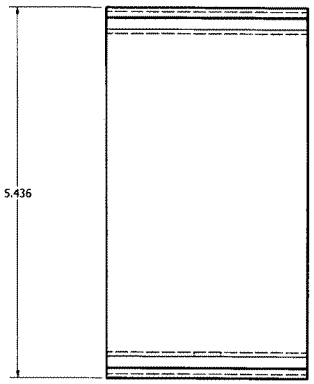
Figure 10B:
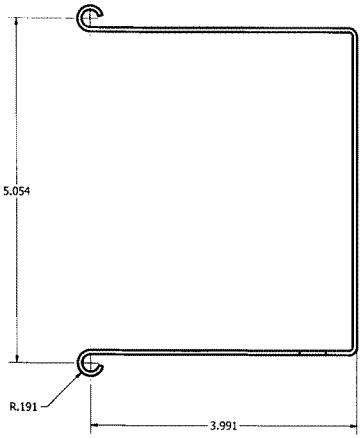
Figure 10D:
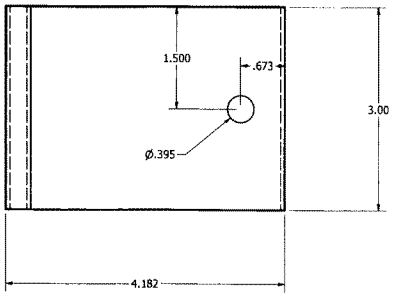

FIGS. 10*a, b, c* and *d* show perspective, side, end and top views of battery support shelf 108.

FIGS. 11*a, b, c* and *d* show perspective, side, end and top views of circuit board mounting shelf 112.

While the invention has been described with reference to specific embodiments, modifications and variations of the invention may be constructed without departing from the scope of the invention, which is defined in the following claims.

We claim:

1. Apparatus comprising a parking space reserver having:

a flexible barrier for raising to reserve a parking space and lowering to permit access to the parking space, a holder positioned above one side of the parking space and connected to one end of the flexible barrier, a weight connected to the flexible barrier near the holder for lowering a part of the flexible barrier near the holder, a drive unit positioned above another side of the parking space and comprising a drive gear therein connected to a portion of the flexible barrier remote from the holder for selectively driving and pulling in and raising the flexible barrier with the drive unit and paying out and lowering the flexible barrier, a control connected to the drive unit for controlling, starting and stopping the drive unit and the pulling in or the paying out of the flexible barrier for respectively raising or lowering the flexible barrier, a housing for enclosing the drive unit, and a shaped flexible barrier guide having a hole and mounted in the housing which aligns the flexible barrier through the hole with the drive gear when the flexible barrier is driven by the drive gear.

2. The apparatus of claim 1, wherein the holder is connected to a post about three feet above the one side of the parking space and the drive unit is fixed on a support spaced and opposite from the post and about three feet above the other side of the parking space.

3. The apparatus of claim 2, wherein the flexible barrier is a chain.

4. The apparatus of claim 2, wherein the drive unit is mounted on a wall spaced from the post.

5. The apparatus of claim 1, wherein the drive unit further comprises:

an electric motor, a power source connected to the motor, a speed reducer connected to the motor, a shaft connected to the speed reducer, and a flexible barrier drive gear connected to the shaft and to the flexible barrier for raising and lowering the flexible barrier.

6. The apparatus of claim 5, further comprising a frame supporting the shaft and a housing connected to the frame for supporting the electric motor and the speed reducer.

7. The apparatus of claim 6, further comprising a stop switch connected to the frame and a stop switch trigger connected to the flexible barrier for engaging the stop switch to stop retracting and raising of the flexible barrier at a desired parking space blocking height.

8. The apparatus of claim 6, wherein the flexible barrier guide is attached to the frame for aligning the flexible barrier with the drive gear.

9. The apparatus of claim 8, wherein the flexible barrier is a chain and the flexible barrier guide is a chain guide for aligning links of the chain with the drive gear.

10. The apparatus of claim 6, further comprising an encoder connected to the shaft for providing the number of revolutions of the shaft and thereby providing information on a position of the flexible barrier.

11. The apparatus of claim 10, wherein the power supply further comprises a battery holder connected to the frame, a solar panel having a mount and electrical connectors connected to the solar panel and extending to the battery holder.

12. The apparatus of claim 11, further comprising front and back covers connected to the frame and to each other for housing the motor, the speed reducer, the shaft, the drive gear, the encoder and the battery holder.

13. The apparatus of claim 10, further comprising a signal receiver and a controller mounted on the frame, the controller connected to the signal receiver and connected to the motor for controlling the motor, and a remote control for signaling the receiver and controlling raising or lowering of the flexible barrier.

14. A method comprising:

providing a parking space reserver, providing an elongated flexible barrier, providing an electric motor and a speed reducer, providing a shaft connected to the speed reducer, and providing a flexible barrier drive gear on the shaft and driving the flexible barrier on the gear shaft for selectively pulling in and raising or paying out and lowering the flexible barrier, providing a housing and enclosing the drive unit, providing a shaped flexible barrier guide having a hole and mounted in the housing and aligning the flexible barrier through the hole with the drive gear when driving the flexible barrier with the drive gear, and remotely signaling a receiver, controlling the electric motor, raising or lowering the flexible barrier, and stopping the motor when the barrier is fully raised to a parking space reserving position or fully lowered to a parking space access position.

15. The method of claim 14, wherein the remotely signaling comprises controlling the raising or lowering of the flexible barrier by the remotely signaling with one of two buttons on a key fob.

16. The method of claim 14, further comprising providing a stop switch connected to the motor and providing a stop switch contactor on a part of the flexible barrier that is close to the drive gear when the flexible barrier is fully raised to a parking space reserving position and thereby stopping the motor with the stop switch when the flexible barrier is fully raised to a parking space reserving position.

17. The method of claim 14, further comprising providing an encoder connected to the drive shaft for counting numbers of turns of the drive shaft, stopping the electric motor after lowering the flexible barrier to a fully lowered position and stopping the electric motor after raising the flexible barrier to a fully upper parking space reserving position.

18. The method of claim 14, wherein one end of the flexible barrier is attached to a fixed first object about three feet above a level of the parking space, and further comprising attaching a weight about three feet from the end of the flexible barrier and first lowering the weight to the parking space level when the flexible barrier is lowered.

19. The method of claim 18, further comprising enclosing the electric motor, the speed reducer, the shaft, the drive gear and the encoder within the housing and fixing the housing to a second object about three feet above the level of the parking space.

* * * * *